US008167747B2

(12) United States Patent
Hawthorne

(10) Patent No.: US 8,167,747 B2
(45) Date of Patent: May 1, 2012

(54) ARROWHEAD

(76) Inventor: Greg Hawthorne, Holden, MO (US)

( * ) Notice: Subject to any disclaimer, the term of this patent is extended or adjusted under 35 U.S.C. 154(b) by 612 days.

(21) Appl. No.: 12/270,031

(22) Filed: Nov. 13, 2008

(65) Prior Publication Data

US 2009/0163309 A1 Jun. 25, 2009

Related U.S. Application Data

(60) Provisional application No. 61/008,681, filed on Dec. 21, 2007.

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS

| | | | | |
|---|---|---|---|---|
| 4,029,319 | A * | 6/1977 | Christen | 473/584 |
| 4,616,835 | A * | 10/1986 | Trotter | 473/583 |
| 6,669,585 | B2 | 12/2003 | Sutherland et al. | |
| 6,887,172 | B2 | 5/2005 | Arasmith | |
| 6,921,348 | B1 | 7/2005 | Johnson | |
| 7,182,706 | B2 | 2/2007 | Barrie | |
| 7,232,390 | B2 | 6/2007 | Mizek et al. | |
| 7,374,505 | B2 * | 5/2008 | Polando | 473/584 |

* cited by examiner

*Primary Examiner* — John Ricci

(74) *Attorney, Agent, or Firm* — Erickson, Kernell, Derussearu & Kleypas, LLC

(57) ABSTRACT

An arrowhead is provided which includes a body and one or more blades fastened to the body. The end of the blade extends behind the end of the body and consequently behind the end of an arrow shaft. This arrangement moves the FOC back towards the center of gravity of the arrow.

18 Claims, 4 Drawing Sheets

ARROWHEAD

CROSS-REFERENCE TO RELATED APPLICATION

This application claims the benefit of a prior filed application Ser. No. 61/008,681, filed on Dec. 21, 2007, entitled ARROWHEAD.

FIELD OF THE INVENTION

The present invention relates generally to arrowheads for use in bow and arrow target shooting and hunting and, more particularly, to an improved arrowhead with superior flight and performance characteristics achieved by extending the blades posterior of the end of the arrow shaft and moving the center of gravity forward.

BACKGROUND OF THE INVENTION

Prior art arrowheads have included multiple fixed or rotating blades. The arrowhead is attached to an arrow shaft. Stability of the arrow and maximizing the delivery of energy to the target is important to achieve a successful result. The length and weight of an arrow, as well as the center of gravity or balance point, affects its flight characteristics. The longer the arrow is the more easily it will bend when shot.

SUMMARY OF THE INVENTION

The present invention provides an arrowhead that shifts the mass of the arrowhead toward the center of the arrow to allow for shorter arrows and thereby increasing the speed and kinetic energy of the arrow.

DESCRIPTION OF THE PREFERRED EMBODIMENT

Figure 1:
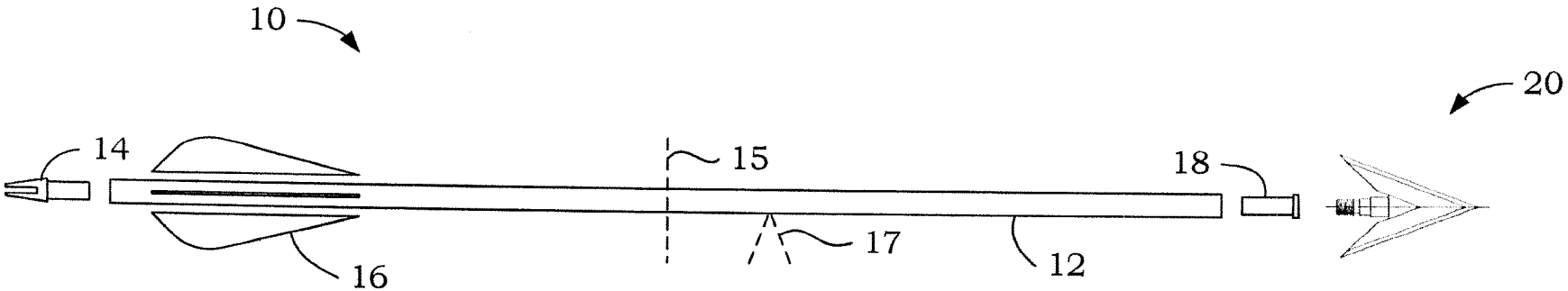
FIG. 1 is an exploded, side elevational view of an arrow and the arrowhead of the present invention.
Figure 2:
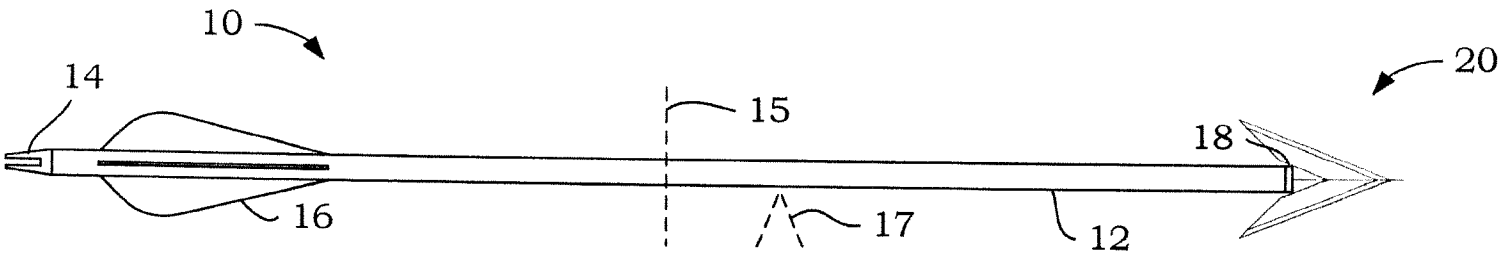
FIG. 2 is a side elevational view of an arrow and the arrowhead of the present invention.
Figure 3:
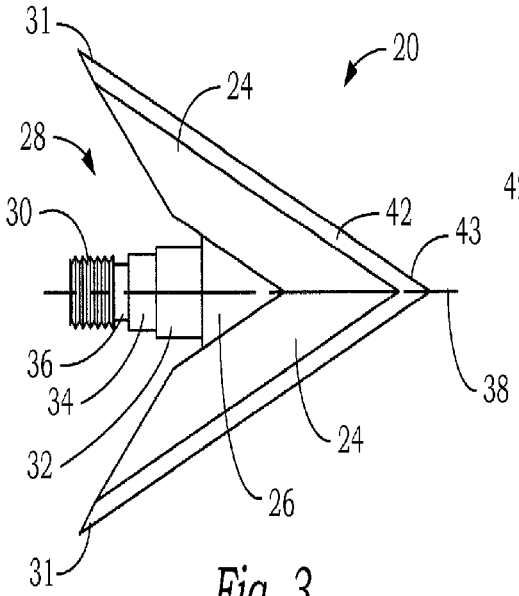
FIG. 3 is a side elevational view of the arrowhead of the present invention.
Figure 4:
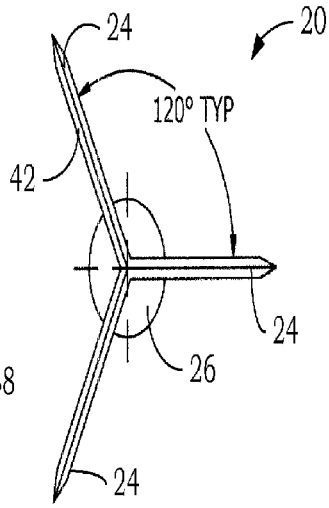
FIG. 4 is a front view of the arrowhead of FIG. 3.
Figure 5:
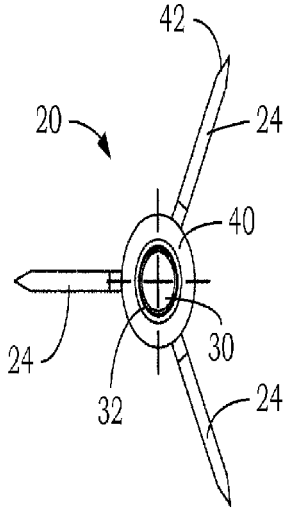
FIG. 5 is a rear view of the arrowhead of FIG. 3.
Figure 6:
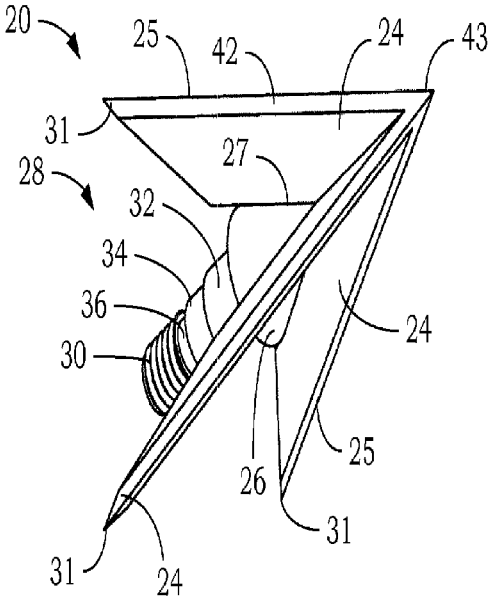
FIG. 6 is a front perspective view of the arrowhead of FIG. 3.
Figure 7:
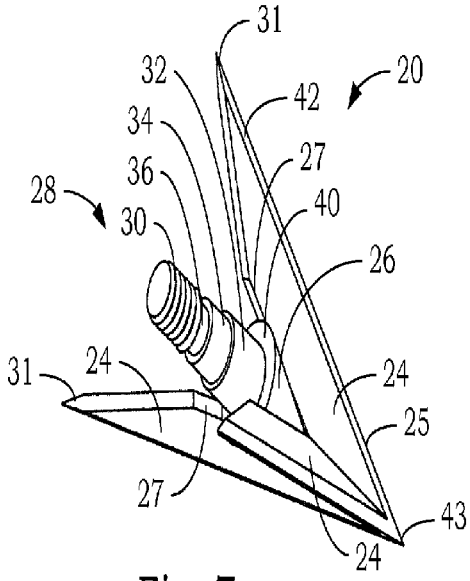
FIG. 7 is a rear perspective view of the arrowhead of FIG. 3.
Figure 10:
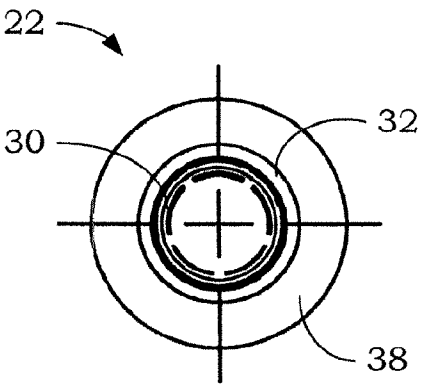
FIG. 10 is a rear view of the arrowhead body of FIG. 8.
Figure 9:
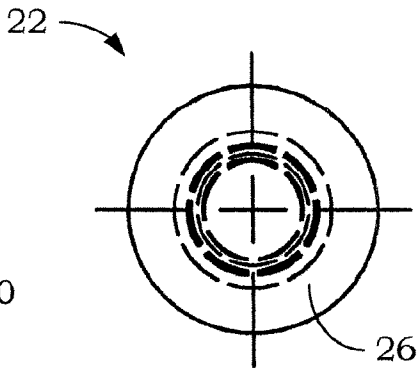
FIG. 9 is a front view of the arrowhead body of FIG. 8.

Referring to FIGS. 1 and 2, an arrow is illustrated and generally identified by reference numeral 10. Arrow 10 includes a shaft 12, a nock 14, fletching 16 and an insert 18. The shaft 12 is typically a long, hollow tube made of aluminum or carbon/graphite composite materials. The rear of the shaft is fitted with the nock 14 which is typically made of molded plastic. The nock 14 allows the arrow 10 to be attached to the string of a bow (not shown). The fletching 16 typically includes three or more vanes or feathers glued onto the shaft 12 in an equally-spaced, circular pattern and provides steering and stabilization of the arrow 10 during flight. The insert 18 is typically an aluminum or plastic sleeve which is glued or pressed into the end of the shaft 12. The insert 18 provides a threaded hole in which to screw in the arrow's tip or arrowhead 20.

In order for the arrow 10 to achieve stable flight and thus accuracy, most of the mass of the arrow must be positioned in front of the center of gravity 15 of the arrow 10. This point is often referred to as the front or forward of center ("FOC") point 17. If all of the mass of the arrowhead is beyond the end of the shaft 12 corresponding to a high FOC 17, the arrow 10 will generally fly well but with a premature loss of trajectory. To move the FOC 17 back toward the center 15 a longer shaft 12 is used or heavier fletching 16. However, this results in an arrow 10 having lower speed and thus lower kinetic energy.

The arrowhead 20 of the present invention shifts the FOC 17 of the arrow toward the center 15 without added weight by extending the mass of the arrowhead 20 back toward the center 15.

Referring to FIGS. 3-7, an arrowhead of the present invention is generally indicated by reference numeral 20. Arrowhead 20 includes a body 22 and three evenly spaced blades 24.

The body 22 of arrowhead 20, as depicted in FIGS. 8-12, is preferably a unitary integral device formed of a cylindrical metal stock. The body 22 has three major portions, a cone-shaped tip 26, a shank 28 and a threaded end 30. In the preferred embodiment, the tip has a 60° taper. Shank 28 includes three concentric cylinders 32, 34 and 36 having a common longitudinal axis 38. The diameter of the cylinders of the shank 28 may vary up to the diameter of the tip 26 at its base 40.

Figure 8:
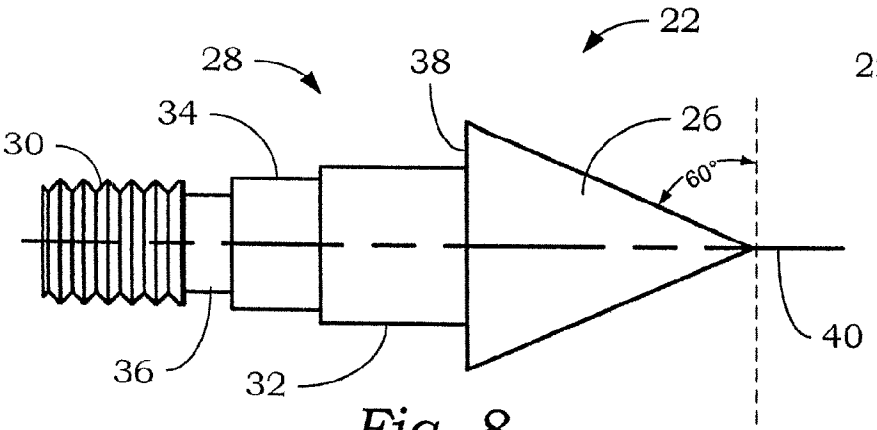
FIG. 8 is an enlarged side view of the body of the arrowhead with the blades removed of FIG. 3.
Figure 8A:
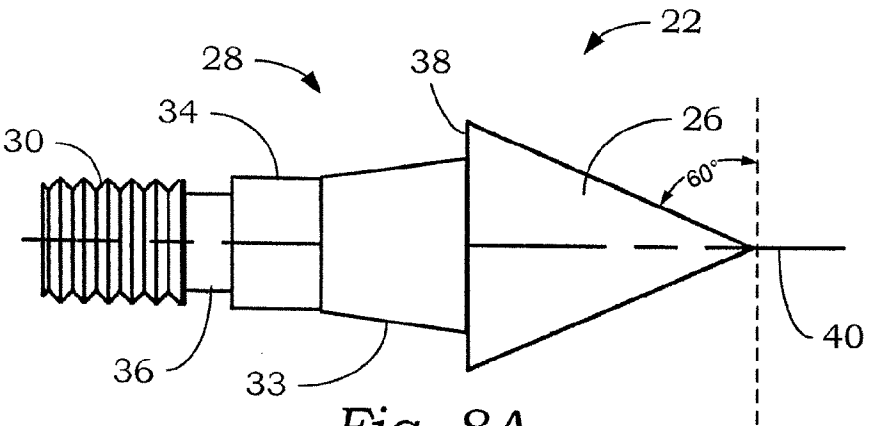
FIG. 8A is an enlarged side view of an alternate embodiment of the body of the arrowhead.
Figure 11:
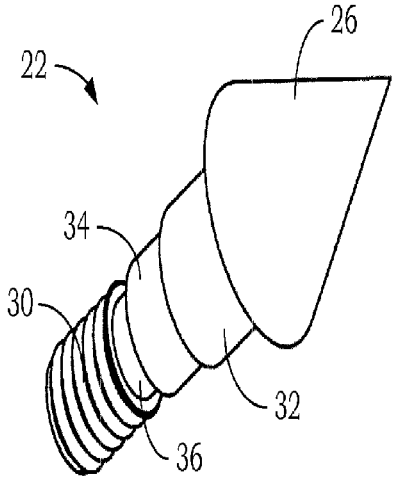
FIG. 11 is a front perspective view of the arrowhead body of FIG. 8.
Figure 12:
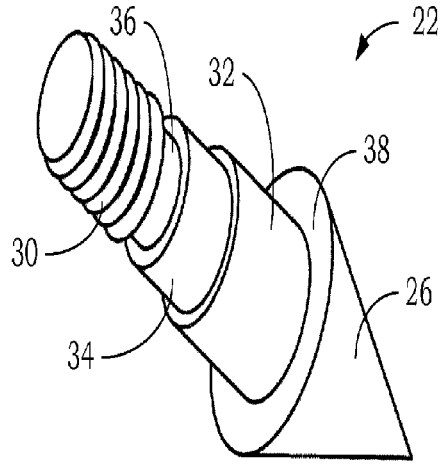
FIG. 12 is a rear perspective view of the arrowhead body of FIG. 8.
Figure 13:
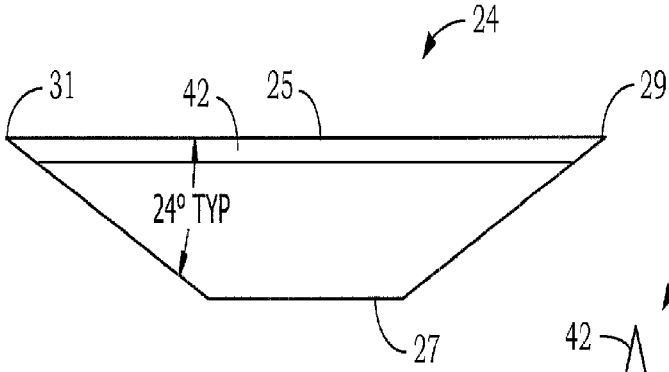
FIG. 13 is a side elevational view of one of the blades of the arrowhead of FIG. 3.
Figure 14:
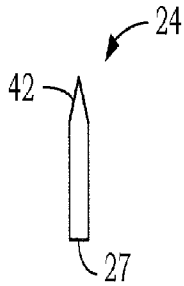
FIG. 14 is an end view of the blade of FIG. 12
Figure 15:
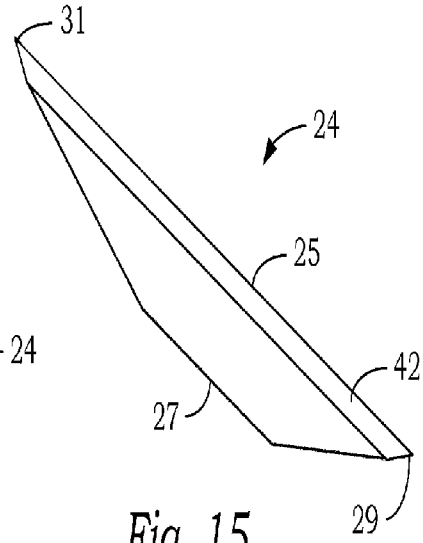
FIG. 15 is a perspective view of the blade of FIG. 13.

The body 22 may be machined from steel, aluminum, or other suitable material or may be cast. Body 22 may be assembled with replaceable or interchangeable cylinders 32, 34 and 36 so that the weight of the arrowhead 20 may be varied as desired by the user. As shown in FIG. 8A, the body 22 may include a frusto-conical section 33. The taper in section 33 allows the arrowhead 20 to be pulled to the center of the shaft as the arrowhead 20 is screwed into the insert 18 (see FIGS. 1 and 2).

Referring to FIGS. 3-7 and 13-15, the arrowhead 20 includes three blades 24 which may be welded or otherwise fastened to the body 22. Although the arrowhead 20 is depicted with three symmetrically-spaced blades 24, other blade configurations and quantities may be used.

Each blade 24 is generally trapezoidal in shape with two parallel edges 25 and 27. It should be understood that other blade shapes may be used. The longer edge 25 is sharpened to provide a cutting edge 42. The shorter edge 27 is secured to the cone-shaped tip 26 of body 22 by welding, gluing, or other fastening method. A point 29 of blade 24 extends forward of tip 26 and forms the tip 43 of arrowhead 20. A tail 31 of blade 24 extends rearward of shank 22 and end 30. When the arrowhead 20 is mounted on the shaft 22 of arrow 10, the tails 31 of blades 24 extend rearward of the insert 18 and end of the shaft 12, which shifts the FOC 17 of the arrow 10 toward the center 15. Blade 24 may be constructed of 18 GA steel or other suitable material. Each end of the blade 24 is cut at a 24° angle. However, other angles may be used depending on the desired cut width and the angle of the body tip 26.

It is to be understood that while certain forms of this invention have been illustrated and described, it is not limited thereto, except in so far as such limitations are included in the following claims and allowable equivalents thereof.

The invention claimed is:

1. An arrowhead comprising:

a body having a generally cone-shaped tip, a shank, an end opposite said tip, and a longitudinal axis, a blade having a point and an end opposite said point, said blade secured to said tip of said body, whereas said point of said blade forms a tip of said arrowhead, and said end of said blade extends longitudinally behind said shank of said body.

2. An arrowhead as set forth in claim 1 wherein said shank includes one or more axially-aligned cylinders.

3. An arrowhead as set forth in claim 2 wherein said cylinders have different weights.

4. An arrowhead as set forth in claim 1 wherein said end of said body includes means for mounting said arrowhead on an arrow shaft.

5. An arrowhead as set forth in claim 1 wherein said point extends in front of said tip of said body.

6. An arrowhead as set forth in claim 1 further comprising two or more blades secured to said tip of said body.

7. An arrowhead as set forth in claim 6 wherein said blades are symmetrically arranged and secured to said tip of said body.

8. An arrowhead as set forth in claim 6 wherein said blades are asymmetrically arranged and secured to said tip of said body.

9. An arrowhead comprising:

a body having a generally cone-shaped tip, a shank, an end opposite said tip, and a longitudinal axis; and blade having a point, an end opposite said point, a fastening surface and an edge opposite said fastening surface;

said fastening surface of said blade secured to said tip of said body;

whereas said point of said blade forms a tip of said arrowhead, whereas said end of said blade extends longitudinally behind said shank of said body.

10. An arrowhead as set forth in claim 9 wherein said shank includes one or more axially-aligned cylinders.

11. An arrowhead as set forth in claim 10 wherein said cylinders have different weights.

12. An arrowhead as set forth in claim 9 wherein said end of said body includes means for mounting said arrowhead to an arrow shaft.

13. An arrowhead as set forth in claim 9 wherein said point extends in front of said tip of said body.

14. An arrowhead as set forth in claim 9 further comprising a plurality of blades secured to said tip of said body.

15. An arrowhead as set forth in claim 14 wherein said points of said plurality of blades form said tip of said arrowhead.

16. An arrowhead as set forth in claim 14 wherein said blades are symmetrically secured to said tip of said body.

17. An arrowhead as set forth in claim 14 wherein said blades are asymmetrically secured to said tip of said body.

18. An arrowhead as set forth in claim 14 wherein said ends of said blades extend longitudinally behind said end of said body.

* * * * *